United States Patent [19]

Hepfer et al.

[11] Patent Number: 4,803,673

[45] Date of Patent: Feb. 7, 1989

[54] STRIKING MECHANISM CLOCK WITH SWITCHABLE LIFTING STUD CYLINDER

[75] Inventors: Rolf Hepfer, Bad Durrheim; Jürgen Rünzler, Spaichingen, both of Fed. Rep. of Germany

[73] Assignee: Joseph Kieninger Uhrenfabrik GmbH, Fed. Rep. of Germany

[21] Appl. No.: 213,785

[22] Filed: Jun. 3, 1988

[30] Foreign Application Priority Data

Mar. 24, 1988 [DE] Fed. Rep. of Germany ..... 3809902

[51] Int. Cl.[4] ..... G04B 21/00

[52] U.S. Cl. ..... 368/269; 368/273

[58] Field of Search ..... 368/75, 269–275

[56] References Cited

U.S. PATENT DOCUMENTS

| | | | |
|---|---|---|---|
| 528,739 | 11/1894 | Porter | 368/272 |
| 529,835 | 11/1894 | Porter | 368/272 |
| 566,956 | 9/1896 | Wright | 368/272 |
| 1,250,173 | 12/1917 | Herschede | 368/271 |
| 1,437,705 | 12/1922 | Baurle | 368/273 |
| 1,468,267 | 9/1923 | Johnston et al. | 368/273 |
| 1,789,044 | 1/1931 | Jauch | 368/269 |
| 1,966,002 | 7/1934 | Carlson | 368/269 |

*Primary Examiner*—Vit W. Miska

*Attorney, Agent, or Firm*—McGlew and Tuttle

[57] ABSTRACT

The invention relates to a striking mechanism clock including a clock movement and a mechanical strike mechanism. The mechanical striking mechanism includes a plurality of striking hammers which have contact levers, the hammers being positioned on a common turning arbor of a hammer shaft. A lifting stud cylinder is provided with a mantle surface having a plurality of groups of lifting studs disposed staggered axially with respect to each other. Each group of lifting studs effect a different striking sequence of the striking hammers. Each of the lifting stud groups is adapted to be brought into a working position by adjusting the working position of the stud cylinder by axially displacing the lifting stud cylinder with respect to contact levers associated with respect to striking hammers. An adjusting element or correcting element including a camming surface or step surface. The steps of the correcting element being connected to the lifting stud cylinder by a contact slider. The contact slider is biased toward the correcting steps of the correcting element. Means are provided including the correcting element for manually adjusting the working position of the lifting stud cylinder. Additionally, means are provided for automatically adjusting the position of the lifting stud cylinder including a cam disk with an annular step cam adapted to be brought into operative connection with the contact slider of the lifting stud cylinder as an alternative to the manual correcting element.

10 Claims, 2 Drawing Sheets

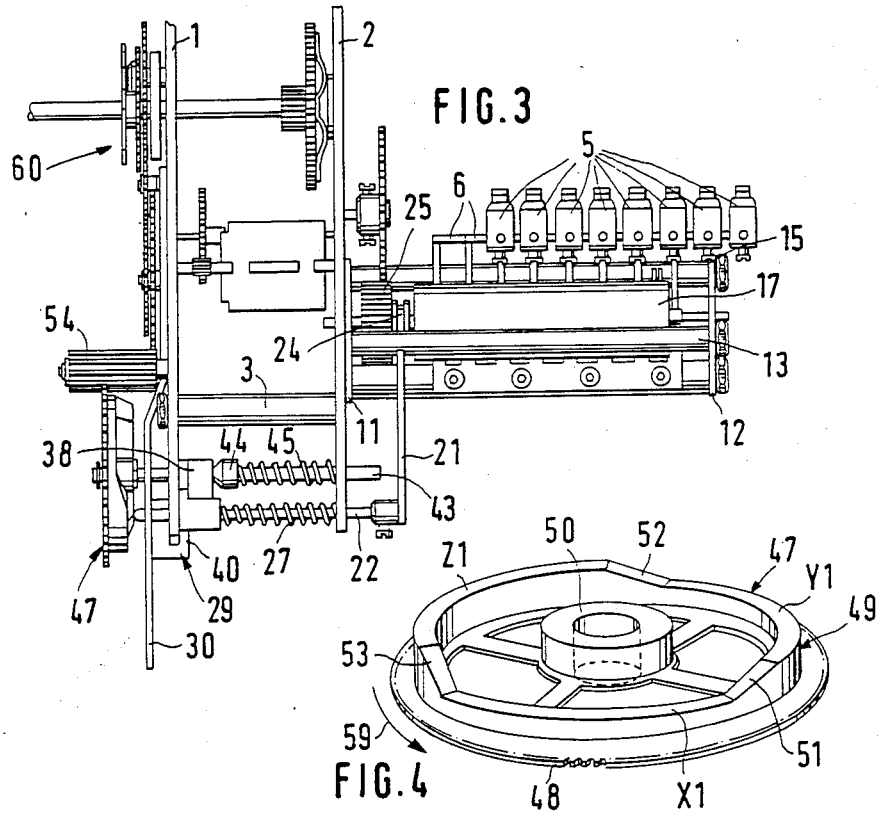
FIG.3
FIG.4
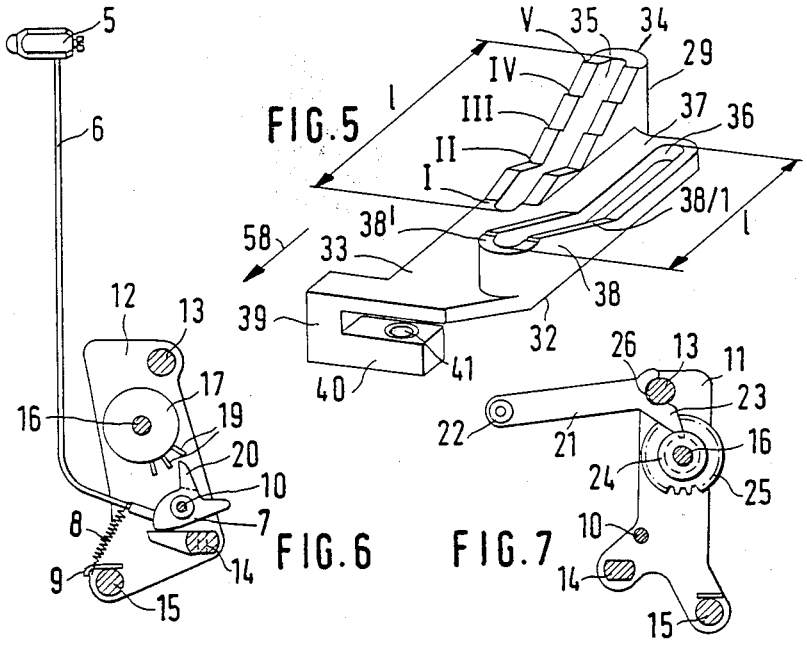
FIG.5
FIG.6
FIG.7

STRIKING MECHANISM CLOCK WITH SWITCHABLE LIFTING STUD CYLINDER

FIELD AND BACKGROUND OF THE INVENTION

The invention relates to a striking mechanism clock, composed of one clock movement and one mechanical striking mechanism.

Known striking mechanism clocks are described in German patents Nos. 177,602 and 509,803. In these striking clocks, instead of a lifting, the stud cylinder on a common shaft there are several fuse disks respectively tracer wheels provided for operating the hammers used for striking. These may be adjusted in common in an axial direction into different switching positions with the shaft onto which they are attached. In the different switching positions, the respective different groups of the fuse disks or tracer wheels can be brought into working position in relation to the contact levers of the striking hammers for the production of different hammer strike sequences. However, in the case of these known striking mechanism clocks, only a manual adjustment of the fuse disks or tracer wheels is possible.

In addition, striking mechanism clocks are known having individual striking hammers which are manipulated by lifting studs of a cylindrical lifting stud roller. These lifting studs are also disposed in groups on the mantle surface of the lifting stud cylinder and can be brought into a confusing position with the contact levers of the striking hammers, by an axial adjustment of the lifting stud cylinder. However, in the case of these striking mechanical clocks, the lifting stud cylinder can only be adjusted manually.

SUMMARY AND OBJECT OF THE INVENTION

It is an object of the invention to provide for a striking mechanism clock using simple means with either a manual adjustment of the lifting stud cylinder or an automatic adjustment of the lifting stud cylinder into the different working positions such that every hour another striking sequence of the striking hammers and thus a different melody is struck.

According to the invention, the setting of the lifting stud cylinder, as a function of time, into its axial work positions, which are manually adjustable by means of the adjusting element, a cam disk with an annular cam step, driven in accordance to time by the clock work can be brought alternatively into working connections with the contact slider of the lifting stud cylinder instead of the adjusting element.

Even though it is suitable for such equipment of the striking mechanism clock, to provide a cam disk showing as many adjusting steps as the manually adjustable adjusting element, so that all the manually adjustable melodies can be set in accordance to time, it would be conceivable as well, to provide a different number of adjusting steps on the cam disk than on the manually adjustable element.

According to the invention, the mechanical striking mechanism comprising several striking hammers disposed on one common turning arbor of a hammer shaft of lifting stud cylinder, a cylindrical mantle cylinder of the hammer shaft supports several groups of lifting studs are disposed staggered axially to each other, each group of lifting studs effecting a different striking sequence of the striking hammers, and each group of lifting studs being capable of being brought into a different striking position by an axial adjustment of the lifting stud cylinder in relation to the contact levers, a manually adjustable correcting element which provides several correcting steps being disposes crosswise to the axis of the lifting stud cylinder and shiftable in a work bedplate, the correcting element being connected to the lifting stud cylinder by a contact slider, strained by springs and running parallel t o the axis of the lifting stud cylinder.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

BRIEF DESCRIPTION OF THE DRAWINGS

In the drawings:

FIG. 3 is a part top-view taken in the direction of arrow B of FIG. 1;

FIG. 4 is a perspective view of a cam disk.

FIG. 5 is a perspective view showing an enlarged representation of the adjusting element as an individual piece;

FIG. 6 is a sectional view taken in the direction of line C—D of FIG. 1;

FIG. 7 is a sectional view taken in the direction of line E-F of FIG. 1

DESCRIPTION OF THE PREFERRED EMBODIMENTS

Figure 1:
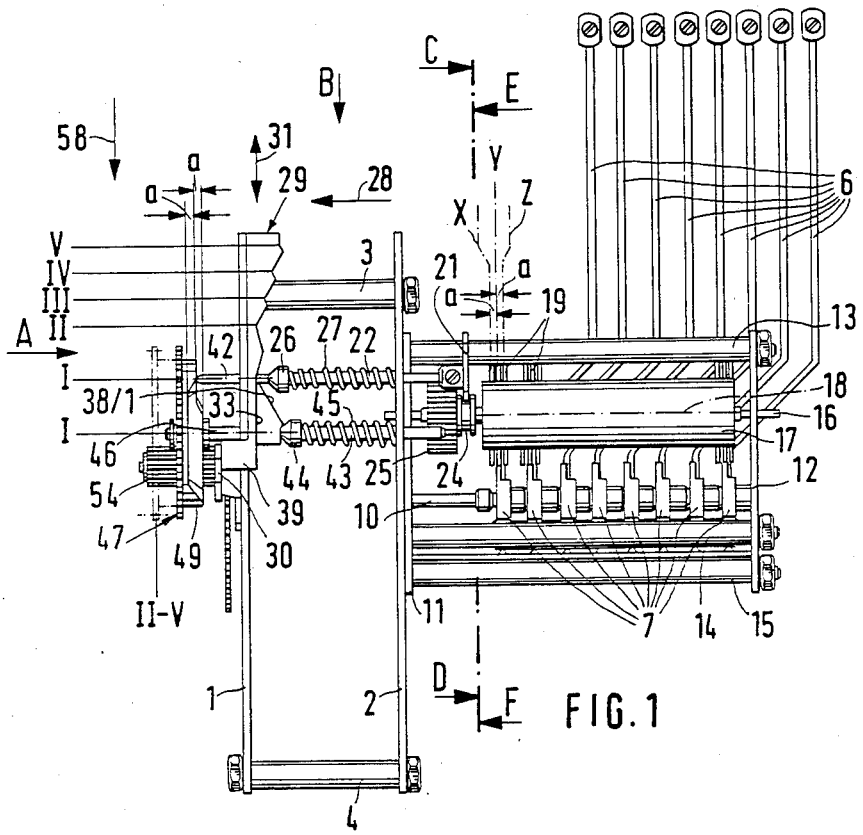
FIG. 1 is a side view showing a simplified representation of the striking mechanism clock.

Referring to the drawing, in particular, the invention relates to a striking mechanism clock including a clock movement and a mechanical striking mechanism. The mechanical striking mechanism includes a plurality of striking hammers which have contact levers, the hammers being positioned on a common turning arbor of a hammer shaft 10. A lifting stud cylinder 17 is provided with a mantle surface having a plurality of groups of lifting studs 19 disposed staggered axially with respect to each other. Each group of lifting studs 19 effect a different striking sequence of the striking hammers. Each of the lifting stud groups is adapted to be brought into a working position by adjusting the working position of the stud cylinder by axially displacing the lifting stud cylinder 17 with respect to contact levers 7 associated with respect to striking hammers 5. An adjusting element or correcting element 29 including a camming surface or step surface. The steps of the correcting element being connected to the lifting stud cylinder 17 by a contact slider 22. The contact slider is biased toward the correcting steps of the correcting element 29. Means are provided including the correcting element for manually adjusting the working position of the lifting stud cylinder. Additionally, means are provided for automatically adjusting the position of the lifting stud cylinder including a cam disk with an annular step cam adapted to be brought into operative connection with the contact slider of the lifting stud cylinder as an alternative to the manual correcting element. The clockwork which is not fully represented in the figures, is disposed between two work bedplates 1 and 2, connected to each other by distance pillars 3 and 4. The represented clockwork provides for the striking of the melody altogether eight striking hammers 8, the respective wire shafts 6 of which run parallel to each other, are lifted off twice, are attached to three-arm contact levers 7, and are under the influence of traction springs 8 which act into traction direction.

The contact levers are together on a hammer shaft 10, immediately next to each other and not slidable in the axial direction, but disposed in two auxiliary bedplates 11 and 12, which are connected to each other by means of distance pillars 13, 14 and 15 and form with them together a bearing support for the hammer work. A lifting stud shaft 17 is also disposed pivotally and slidable in the axial direction by means of a shaft 16. The axis 18 of this lifting stud shaft runs parallel to the hammer shaft 10.

This lifting stud cylinder 17 provides on its cylindrical circumference a big number of lifting studs 19, being assigned in groups of three respectively to one contact lever 17. The arrangement of these lifting studs 19 is fashioned in such a way, that the lifting studs assigned to one group and one contact lever 7 respectively sit in one common axis plane X, Y, Z, providing the same axial distance a to the respective next group which is assigned to the same contact lever 7. In FIG. 1, only groups of lifting studs assigned to the two left contact levers 7 and the utmost right contact lever are shown.

For the exploration of the lifting studs 19, revolving with the turning of the lifting stud cylinder 17, the contact levers 7 provide narrow contact fingers 20, which extend into the circulation paths of the individual lifting studs 19 and are inclined clockwise by the lifting studs like in a haul out movement of the striking hammers, as FIG. 6 shows as well.

I order to bring the individual groups of the lifting studs 19 with the contact fingers 20 of the contact levers 7 into an aligned position, meaning into the same axial plane as the contact finger 20, the lifting stud cylinder 17 is slidable in axial direction with it shaft 16 and is connected with a contact slider 22 in the shape of a bear by means of a sliding lever 21, the contact slider being disposed parallel to the axis 18 of the lifting stud cylinder and being disposed in the two work bed plates 1 and 2. In the course of this, the sliding lever 21 engages form-locking into a groove roller 24, which is attached onto the shaft 16 together with a gear wheel 25 stiff against rotation and not slidable in axial direction. At the same time, the slide lever 21 is lead through a furcated recess 26 at the distance pillar 13, so that the arm 23 cannot leave the groove roller 24.

Between the work bedplate 2 facing the hammer work and a contact member 26 in the shape of a truncated cone fitting tightly on the contact slider 22 in the shape of a bar a pressure spring 27 which surrounds the part of the contact slider 22 and exerts pressure onto the contact element 26 and thus onto the contact slider 22 as well in direction of the arrow 28 and that is against the work bedplate 1 on the opposite side.

On the inner side of the work bedplate 1, an adjusting element 29 is disposed which is represented as an individual piece. It is movable in the direction of the double arrow by means of a manually operable adjusting lever 30 disposed on the outside of the work bedplate 1. This adjusting element 29 provides a plane and even side 32, which lies to the inner side of the work bedplate 1 and a plane surface 33 parallel to it, facing the contact element 26. On the side of the surface 33 several adjusting steps II, III, IV and V are disposed, which ascend towards the upper end 34 and in the longitudinal middle of which a continuous slot 35 is disposed. The lowest adjusting step I is formed by the surface 33 itself, into which the slot 35 extends in a semicircular direction.

Next to the adjusting steps I through IV, a second slot 36, parallel to the slot 35 is disposed, the length of which corresponds to the length of the slot 35 and which extends in the area of the adjusting steps II through IV i a plane part 37 and which continues in an adjusting dog 38, which is disposed in the area of the surface 33.

For guiding along the workplate 1, a U-shaped clamp 39 is connected to the end of the correcting element 29, which is opposite to the correcting steps II through V. The free arm 30 of the clamp 39 lies leading on the outer side of the work bedplate 1 and is connected flexibly with the adjusting lever 30 by means of an invisible hinge pin sitting in a boring 41.

The contact slider 22 provides a prolongation fashioned as a contact finger 42, the prolongation extending through the slot 35 and a corresponding boring in the work bedplates 1 and 2 and the adjusting shaft 43 is disposed staggered to the adjusting slider 22 but running parallel to it, the adjusting shaft 43 being attached stationary but adjustable axially in radial direction. This adjusting shaft 43 provides in the manner of the contact slider 22 a contact element 44 in the shape of a truncated cone, the contact element being slidable in the axial direction by means of an adjusting cam 38. Between the contact element 44 and the work bedplate 2 a pressure spring 45 is disposed onto the adjusting shaft 43, which also exerts pressure onto the contact element in the direction of the arrow 28 and thus as well onto the adjusting shaft 43. The adjusting shaft extends through the slot 36 of the adjusting element 29 and through the work bedplate 1. A cam disk 47 is disposed pivotally but not slidable in axial direction onto a section 46 of the outside of the work bedplate 1. The cam disk is represented perspectively as an individual piece in FIG. 4.

This cam disk 47 has a circular shape and includes peripheral teeth 48 at its circumference. On the front side facing the work plate 1, an annular step cam 49 is provided, which is disposed concentric to the facial teething 48 and to a central bearing hub 50, and which provides three adjusting steps X1, Y1, and Z1, which are explored one after the other by the contact finger 42 in the direction of rotation of the arrow 59 corresponding to the distance a, by which the lifting stud groups X, Y, Z are staggered to each other on the lifting stud cylinder.

The adjusting shaft 43 is disposed in such a way, that the cam surface on the front of the step cam 49 is arranged in the middle of the axis of the adjusting slider 22, respectively of the contact finger 42 and so that the contact finger 42 sits on the step cam 49, when the cam disk 47 is in an axial position, such as shown in FIG. 1, by the drawn lines, in the position of which the contact element 44 of the adjusting shaft 43 sits on the highest adjusting surface 38' of the adjusting cam 38.

FIG. 1 shows that in this position the adjusting member 29 takes its vertically highest position and that the surface 3 is situated in the area of the adjusting slider 22 or its contact element 26, meaning it is not influenced by the adjusting steps II through V. In the course of this, the adjusting lever 30 takes the position I shown in FIG. 2.

The facial teething 48 of the cam disk 47 is in working connection with the hour wheel of the index plate 60 by means of a pinion 54 and other cog wheels 55, 56,. 57 and is driven by it in such a away, that it effects one full rotation in three hours. During this rotation movement, each time when the contact finger 42 slides over one of the oblique surfaces 51, 52 or 53 an axial adjustment is carried out as well for the contact slider 22 as for the lifting stud cylinder 17. This has the effect, that in this working position of the cam disk 47 there is a different striking sequence of the striking hammers 5 each hour, because another lifting stud group X, Y, Z respectively cooperates with the contact levers 7.

Figure 2:
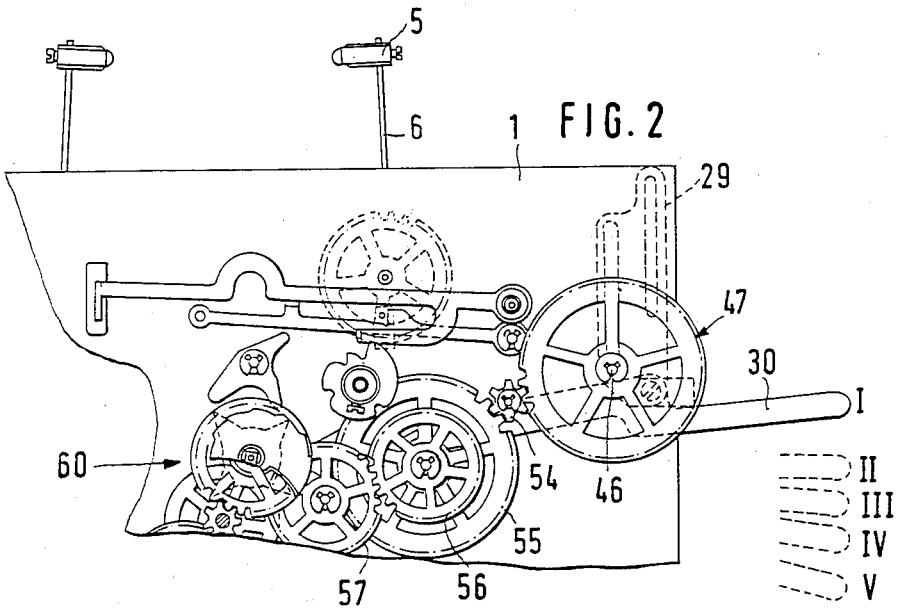
FIG. 2 is a front view showing a part-front view taken in the direction of arrow A of FIG. 1.

If this change-over of the striking melody or of the sequence of the hammers strokes every hour is not desired, there is a possibility to set permanently or transitory one of the three stroke sequences by setting the adjusting lever 30 into the position II, III or IV of FIG. 2.

In the adjustment of the adjusting lever 30 the adjusting element 29 is slid in the direction of the arrow 58. In the course of this, the contact member 44 of the adjusting shaft 43 slides over the oblique cam surface 38/1, which causes an axial displacement of the cam disk 47 into its resting position shown by the dotted line of FIG. 1, in which the contact finger 42 of the adjusting slider 22 cannot be influenced any more by the cam disk 47, which continues revolving. Instead the contact element 26, takes over the function of the adjusting slider 22 and sits on one of the adjusting steps II, III or IV in which the respectively assigned lifting stud group X, Y, or Z determines the sequence of hammer strokes of the striking melody.

When the adjusting member 29 is brought into its vertical position, in which the adjusting lever 30 takes the position V such as shown in FIG. 2, the contact element 26 sits on the highest step V of the adjusting element 29, in which the lifting stud roller 17 is slid so far in the opposite direction of the arrow 28, that all of the lifting stud groups stand between, respectively next to the contact fingers 20 of the contact levers 7 and cannot influence the striking hammers 5.

The adjusting element 29 as well as the cam disk 47 can be manufactured out of synthetic in one piece. It is apparent, that by using one single adjusting lever 30 and one single adjusting lever 29, which is operated by this adjusting lever 30, the manual selection of the desired hammer stroke sequence and the striking melody as well as the stroke sequence which changes every hour, can be st in a very easy way, with very few elements in an economical manner.

While specific embodiments of the invention have been shown and described in detail to illustrate the application of the principles of the invention, it will be understood that the invention may be embodied otherwise without departing from such principles.

What is claimed is:

1. A striking mechanism clock, comprising a clock movement and a mechanical striking mechanism including a plurality of striking hammers having contact levers, the hammers being disposed on one common turning arbor of a hammer shaft, a lifting stud cylinder with a mantle surface having a plurality of groups of lifting studs disposed staggered axially with respect to each other, each group of which effecting a different striking sequence of the striking hammers, and each group adapted to being brought into a working position by an axial displacement of the lifting stud cylinder in relation to contact levers of the striking hammers; a manually adjustable correcting element which has several correcting steps disposed crosswise to the axis of the lifting stud cylinder and shiftable on a work bedplate, said correcting element being connected to the lifting stud cylinder by a contact slider, said contact slider being spring biased toward the correcting steps running parallel to the axis of the lifting stud cylinder, the lifting stud cylinder being set in response to said clock movement into one of a plurality of working positions; means for manually adjusting the working position of the lifting stud cylinder including the corresponding element; and means for automatically adjusting the position of the lifting stud cylinder including a cam disk with an annular step cam adapted to be brought into operative connection with the contact slider of the lifting stud cylinder alternatively instead of the manual control element.

2. A striking mechanism clock according to claim 1, wherein: the cam disk is disposed in a position about an axis parallel to the axis of the lifting stud cylinder and is manually removable in an axial direction between an inactive resting position and an active working position, and wherein the cam disk includes a step cam on a front side.

3. A striking mechanism clock according to claim 1, wherein the cam disk is pivotally seated on an adjusting shaft and is not shiftable in axial direction, the adjusting shaft running parallel to the axis of the lifting stud cylinder and being adjustable between the resting position and the working position of the cam disk by means of a manually shiftable adjusting dog.

4. A striking mechanism clock according to claim 3, wherein the adjusting shaft is disposed movable in an axial direction in work bedplates associated with the clock movement, the adjusting t-shaft having a contact element which lies closely to the adjusting dog under the influence of an axially acting pressure spring as well as an extension part bearing the cam disk and being lead through the adjusting dog or passing by the adjusting dog.

5. A striking mechanism clock according to claim 4, wherein: the step cam of the cam disk is disposed as an axial prolongation of the contact slider in the shape of a bar, and in that the contact slider provides both a contact element, which cooperates with adjusting steps of the control element, a contact finger which is prolonged past the correcting element or through the correcting element, in the axis of which the steps cam runs.

6. A striking mechanism clock according to claim 5, wherein: the adjusting dog of the adjusting shaft is connected to the control element of the contact slider in such a way that the adjusting dog keeps the adjusting shaft with the cam disk in its working position, when none of the adjusting steps of the correcting element is in gear with the adjusting slider.

7. A striking mechanism clock according to claim 1, wherein: the cam disk is disposed on the side of the index plate and is driven by the index plate with such an adjustment factor, such that the lifting stud cylinder is brought into another adjusting position every hour with a different sequence of hammer striking.

8. A striking mechanism clock according to claim 1, characterized in that the cam disk is fashioned annularly and provides a radial teeth through which it is in a continuous gear with an index plate of the clock movement.

9. A striking mechanism clock according to claim 8, wherein: the cam disk including the step cam and its radial tee h is made up of synthetic material in one piece.

10. A striking mechanism clock, comprising a clock movement and a mechanical striking mechanism including: a hammer shaft holding striking hammers having contact levers; a lifting stud cylinder with a surface supporting a plurality of groups of lifting studs, each of said groups of lifting studs being staggered axially with respect to one another, each of said groups of lifting studs effecting a different striking sequence of the striking hammers depending upon a working position of the lifting stud cylinder in relation to the contact levers of the striking hammers, automatic means for automatically adjusting the working position of the lifting stud cylinder in an axial direction including a cam disk responsive to movement of said clock movement, said cam disk having an annular step cam adapted to be brought into operative connection with a contact slider connected to said lifting stud cylinder and axially biased toward said cam disk; and, manually adjusting means for disconnecting said means for automatically adjusting the position of the lifting stud cylinder and for manually adjusting the working position of the lifting stud cylinder.

* * * * *